US009128457B2

(12) United States Patent
Koga

(10) Patent No.: US 9,128,457 B2
(45) Date of Patent: Sep. 8, 2015

(54) IMAGE FORMING APPARATUS WITH MOVABLE CONVEYING PATH

(71) Applicant: Canon Kabushiki Kaisha, Tokyo (JP)

(72) Inventor: Yutaka Koga, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/795,197

(22) Filed: Mar. 12, 2013

(65) Prior Publication Data

US 2013/0287412 A1 Oct. 31, 2013

(30) Foreign Application Priority Data

Apr. 25, 2012 (JP) ..... 2012-100138

(51) Int. Cl.
*G03G 15/00* (2006.01)
*G03G 21/16* (2006.01)

(52) U.S. Cl.
CPC ..... *G03G 21/1676* (2013.01)

(58) Field of Classification Search
USPC ..... 399/9, 13, 34, 35, 123, 343, 358, 360
See application file for complete search history.

(56) References Cited

U.S. PATENT DOCUMENTS

| | | | | |
|---|---|---|---|---|
| 6,091,912 | A * | 7/2000 | Kitajima et al. | 399/13 |
| 7,613,407 | B2 * | 11/2009 | Craig et al. | 399/35 |
| 8,126,340 | B2 * | 2/2012 | Bito et al. | 399/35 |
| 2007/0177886 | A1 * | 8/2007 | Taguchi et al. | 399/12 |

FOREIGN PATENT DOCUMENTS

| | | | |
|---|---|---|---|
| JP | 6-12005 | A | 1/1994 |
| JP | 2002-169441 | A | 6/2002 |
| JP | 3743282 | B2 | 2/2006 |
| JP | 2006-259524 | A | 9/2006 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes: an image forming portion which forms a toner image; a collecting container which is detachably arranged in an apparatus main body and which collects toner discharged from the image forming portion; a conveying path which conveys the toner discharged from the image forming portion toward the collecting container, the conveying path being arranged in the apparatus main body to be turnable to a first position positioned during operation of the main body and a second position different from the position positioned in the operation of the main body; and a fixing portion which can fix the conveying path at the first position and the second position.

8 Claims, 10 Drawing Sheets

IMAGE FORMING APPARATUS WITH MOVABLE CONVEYING PATH

BACKGROUND OF THE INVENTION

1. Field of the Invention

The present invention relates to an image forming apparatus including a conveying mechanism for conveying toner collected from a surface of an image bearing member.

2. Description of the Related Art

Conventionally, in the image forming apparatus, the toner remaining on the surface of the image bearing member is removed by a cleaning portion such as a cleaning blade, and collected in a collecting container through a predetermined conveying path. The collecting container is detachably attached to a main body of the image forming apparatus to clean and reuse the collecting container, in which case the toner may scatter or the surrounding area may become polluted.

As an invention for solving such problem, an invention described in Japanese Patent Laid-Open No. 2002-169441 is disclosed. The invention disclosed in Japanese Patent Laid-Open No. 2002-169441 relates to a configuration in which a cover is arranged at a terminating end of the conveying path of the toner to be collected. According to such configuration, discharging failure of the collected toner can be prevented, the task of attaching the collecting container to the apparatus main body can be facilitated, and the cover can be prevented from being closed without the collecting container attached to the apparatus main body.

However, the collecting container of the collected toner is installed so as to weave through a gap of a space inside the apparatus main body due to high density of the mounted components inside the image forming apparatus of recent years. Thus, when performing maintenance on the inside of the apparatus main body to change the component, the conveying path itself for conveying the collected toner needs to be moved, which increases the maintenance time and scatters the toner accompanied by the dissembling of the conveying path. Therefore, the invention described in Japanese Patent Laid-Open No. 2002-169441 is not sufficient to address the problem described above.

SUMMARY OF THE INVENTION

In light of the foregoing, it is desirable to provide an image forming apparatus in which the conveying path for conveying the toner can be moved without dissembling the conveying path at the time of performing maintenance on the image forming apparatus, thus facilitating the maintenance.

An image forming apparatus including: an image forming portion which forms a toner image; a collecting container which is detachably arranged in an apparatus main body and which collects toner discharged from the image forming portion; a conveying path which conveys the toner discharged from the image forming portion toward the collecting container, the conveying path being arranged in the apparatus main body to be turnable to a first position positioned during operation of the main body and a second position different from the position positioned in the operation of the main body; and a fixing portion which fixes the conveying path at the first position and the second position.

Further features of the present invention will become apparent from the following description of exemplary embodiments with reference to the attached drawings.

DESCRIPTION OF THE EMBODIMENTS

Hereinafter, an exemplary embodiment of the invention will be described in detail with reference to the drawings. Sizes, materials, shapes and relative positions of components described in the embodiment are appropriately changed according to configurations and various conditions of the apparatus to which the invention is applied. Therefore, the scope of the invention is not limited to the sizes, materials, shapes or relative positions unless otherwise noted.

Figure 1:
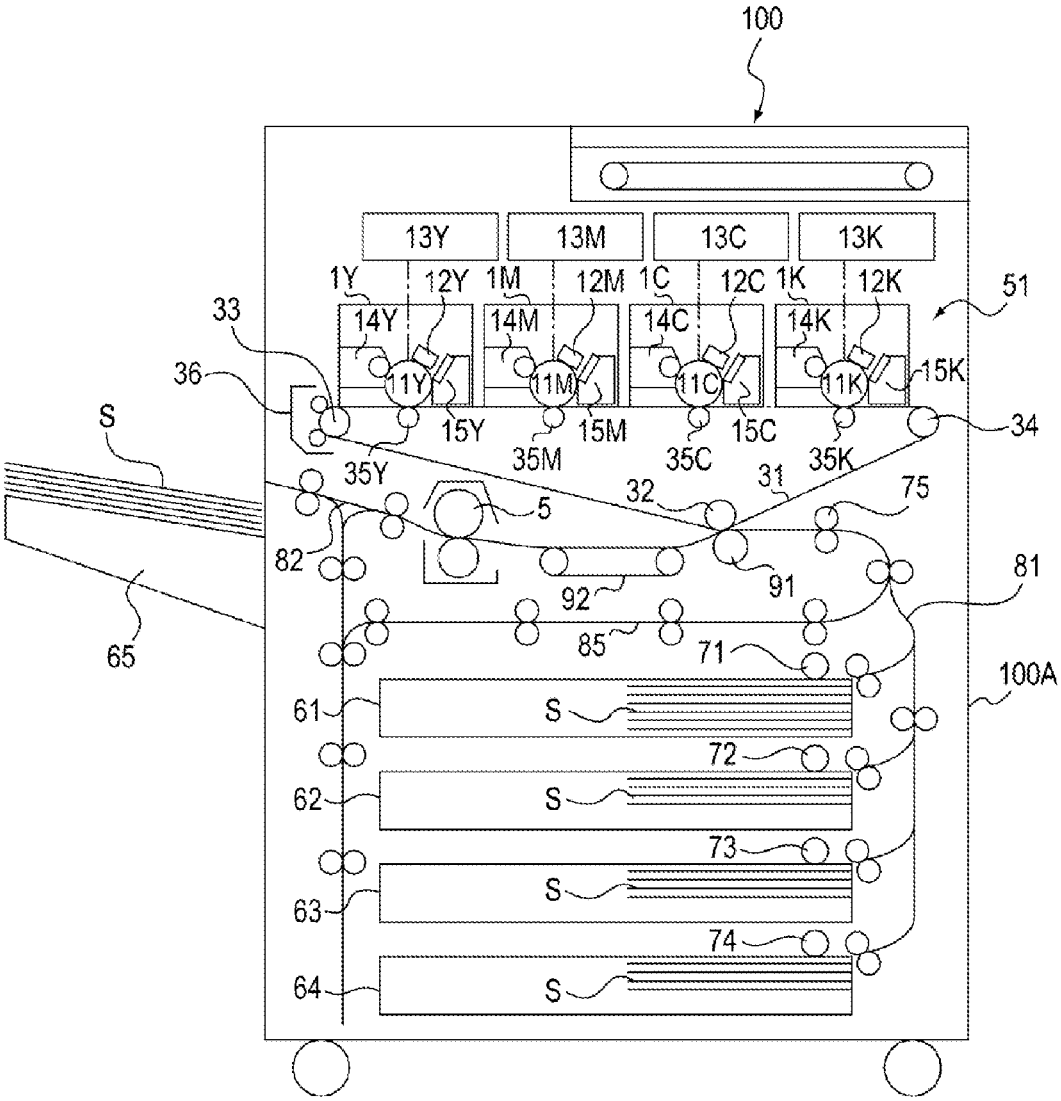
FIG. 1 is a cross-sectional view illustrating a configuration of an image forming apparatus according to one embodiment of the present invention.

FIG. 1 is a cross-sectional view illustrating a configuration of an image forming apparatus 100 according to one embodiment of the present invention. The image forming apparatus 100 is an image forming apparatus that uses an electrophotographic image forming process. As illustrated in FIG. 1, the image forming apparatus 100 includes an image forming apparatus main body (hereinafter simply referred to as "apparatus main body") 100A, where an image forming portion 51 for forming an image is arranged inside the apparatus main body 100A. The image forming portion 51 includes a photosensitive drum 11, which serves as an "image bearing member", and a transfer roller 35, which serves as a "transfer device". At least the photosensitive drum 11 may be included in a process cartridge, and may be incorporated in the apparatus main body 100A as the process cartridge.

The image forming apparatus 100 is a tandem intermediate transfer type image forming apparatus in which image forming portions 1Y, 1M, 1C, and 1K are arranged in series on a horizontal portion of an intermediate transfer belt 31. The image forming portion 51 forms a full color image on a sheet S through the electrophotographic system according to an image signal transmitted from an external device.

The image forming portions 1Y, 1M, 1C, and 1K form each color toner image of yellow, magenta, cyan, and black on photosensitive drums 11Y, 11M, 11C, and 11K, and performs primary transfer onto the same image position on the intermediate transfer belt 31. The intermediate transfer belt 31 is bridged across by a drive roller 33, a tension roller 34, and a transfer counter roller 32, which performs secondary transfer, and rotates thereon. Primary transfer rollers 35Y, 35M, 35C, and 35K for performing the primary transfer are arranged at positions facing the photosensitive drums 11Y, 11M, 11C, and 11K on an inner peripheral surface side of the intermediate transfer belt 31.

A charger 12Y, an exposure device 13Y, a development device 14Y, and a cleaning device 15Y are arranged at a periphery of the photosensitive drum 11Y, which serves as the "image bearing member", on which the yellow toner image is formed. The charger 12Y is a device for uniformly charging the surface of the photosensitive drum 11Y. The exposure device 13Y is a device for irradiating an image light on the photosensitive drum 11Y to form a latent image on the surface thereof. The development device 14Y is a device for transferring the toner onto the latent image on the photosensitive drum 11Y to form a toner image. The cleaning device 15Y, which is the "cleaning portion", is a device that includes a cleaning blade 15Y1 (see FIG. 2), and that cleans (removes) the toner remaining on the surface of the photosensitive drum 11 after the primary transfer of the toner image. The configuration for forming the toner image of magenta, cyan, and black can be understood by replacing the suffix Y with M, C, K in the description made above.

The sheet S stored in sheet feeding cassettes 61, 62, 63, 64 is conveyed to a sheet feeding conveying path 81 when one of sheet feeding rollers 71, 72, 73, 74 is rotated. A registration roller 75 feeds the sheet S to a secondary transfer portion formed when the secondary transfer roller 91 and the transfer counter roller 32 make contact according to the timing of the toner image on the intermediate transfer belt 31.

The sheet S transferred with the toner image is conveyed to a fixing device 5 by a conveying belt 92, and subjected to heating and pressure bonding by the fixing device 5 to securely attach the toner image on the surface of the sheet S thus fixing the full color image, and is then fed to a discharge tray 65 through a sheet discharge conveying path 82.

The residual toner on the photosensitive drum 11 and the intermediate transfer belt 31 that was not completely transferred to the sheet is removed by the cleaning portion arranged in each of the photosensitive drum 11 and the intermediate transfer belt 31. The toner removed by the cleaning portion is passed through the conveying path for the collected toner, and accommodated in the collecting container.

Figure 2:
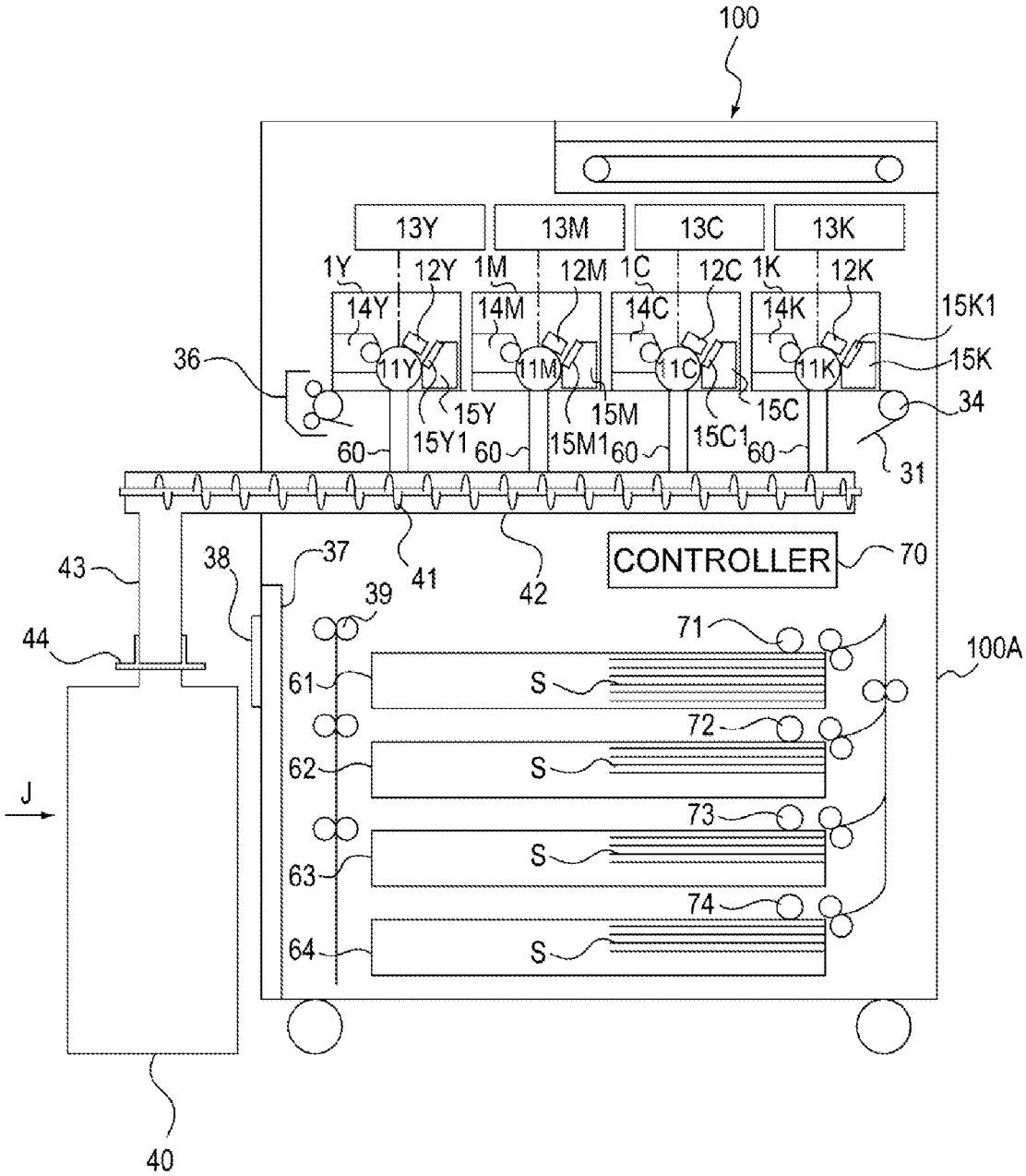
FIG. 2 is a cross-sectional view illustrating a configuration of a toner conveying mechanism arranged inside the image forming apparatus.

FIG. 2 is a cross-sectional view illustrating a configuration of a toner conveying mechanism arranged inside the image forming apparatus 100. As illustrated in FIG. 2, the cleaning device 15 (15Y, 15M, 15C, 15K) is arranged facing the respective photosensitive drum 11 of Y, M, C, and K. A cleaning device 36 is arranged facing the intermediate transfer belt 31. The toner collected by the cleaning device 15 and the cleaning device 36 is moved to a pipe 42 through a conveying tube 60. The pipe 42, which serves as a "first conveying path", is a member that extends in a horizontal direction inside the apparatus main body 100A to convey the toner. The toner that moved to the pipe 42 is conveyed towards a left side by a conveying screw 41 arranged inside the pipe 42 that is arranged in a horizontal position.

A pipe 43, which is arranged in a vertical position extending in a vertical direction, is rotatably attached to a left end of the pipe 42. The pipe 43, which serves as a "second conveying path", is a member for conveying the toner, which extends in a direction orthogonal to an axial direction of the pipe 42 to one end of the pipe 42 and is freely rotatable with an axis of the pipe 42 as a center. A shutter 44 is attached to a lower end of the pipe 43. The shutter 44 is a member that closes an opening 43*k* of the pipe 43 when a collecting container 40 is detached, and that opens the opening 43*k* of the pipe 43 when the collecting container 40 is attached (see FIG. 3 and FIG. 4). The collecting container 40 arranged on a lower side thereof is a container that is detachably attached to the apparatus main body 100A to collect the toner collected by the cleaning device 15 and the cleaning device 36.

A controller 70 for controlling the drive of an internal device of the apparatus main body 100A is arranged inside the apparatus main body 100A. The controller 70 simultaneously performs presence/absence determination of determining whether or not the collecting container 40 is present inside the apparatus main body 100A from the position of the shutter 44, and open/close determination for determining whether or not the pipe 43 is closed by the shutter 44.

Figure 3:
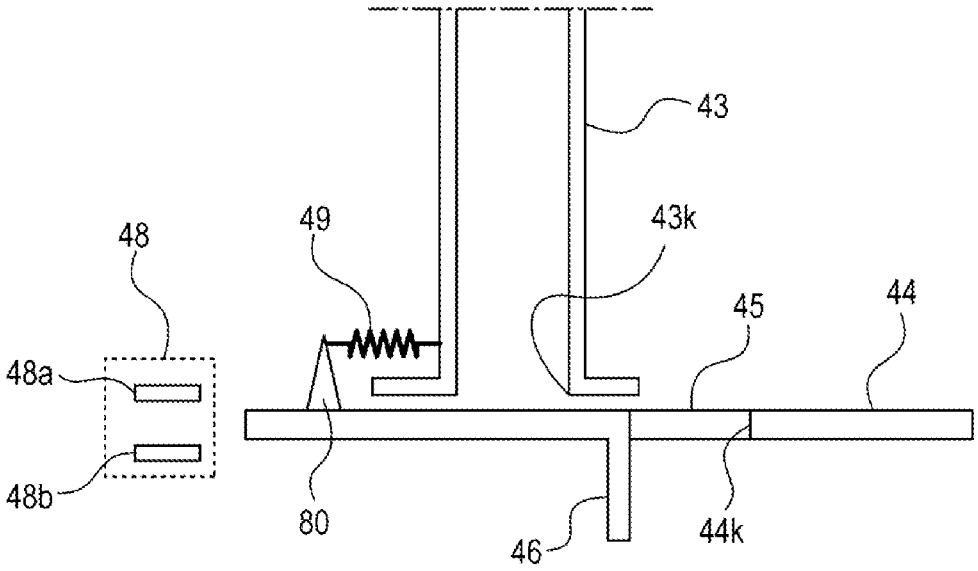
FIG. 3 is a side view illustrating a state in which an opening of a pipe is closed by a shutter seen from a direction of an arrow J in FIG. 2.

FIG. 3 is a side view illustrating a state in which the opening 43*k* of the pipe 43 is closed by the shutter 44 seen from a direction of an arrow J in FIG. 2. As illustrated in FIG. 3, the opening 43*k* is formed at the lower end of the pipe 43. One end of a spring 49 is attached to an outer surface of the pipe 43. The spring 49, which serves as a "force applying portion", is a member that applies force on the pipe 43 so as to pull a supporting portion 80 of the shutter 44 to obtain a state in which the pipe 43 is closed by the shutter 44. An opening 44*k* is formed in the shutter 44. The supporting portion 80 for supporting the other end of the spring 49 is arranged on an upper surface of the shutter 44. From an edge on the left side of the opening 44*k* of the shutter 44 extends a container contacting portion 46, which can make contact with the collecting container 40, toward the lower side. On a left side of the shutter 44 is arranged a sensor 48, which serves as a "detecting portion" for detecting the opening/closing of the shutter 44.

Figure 4:
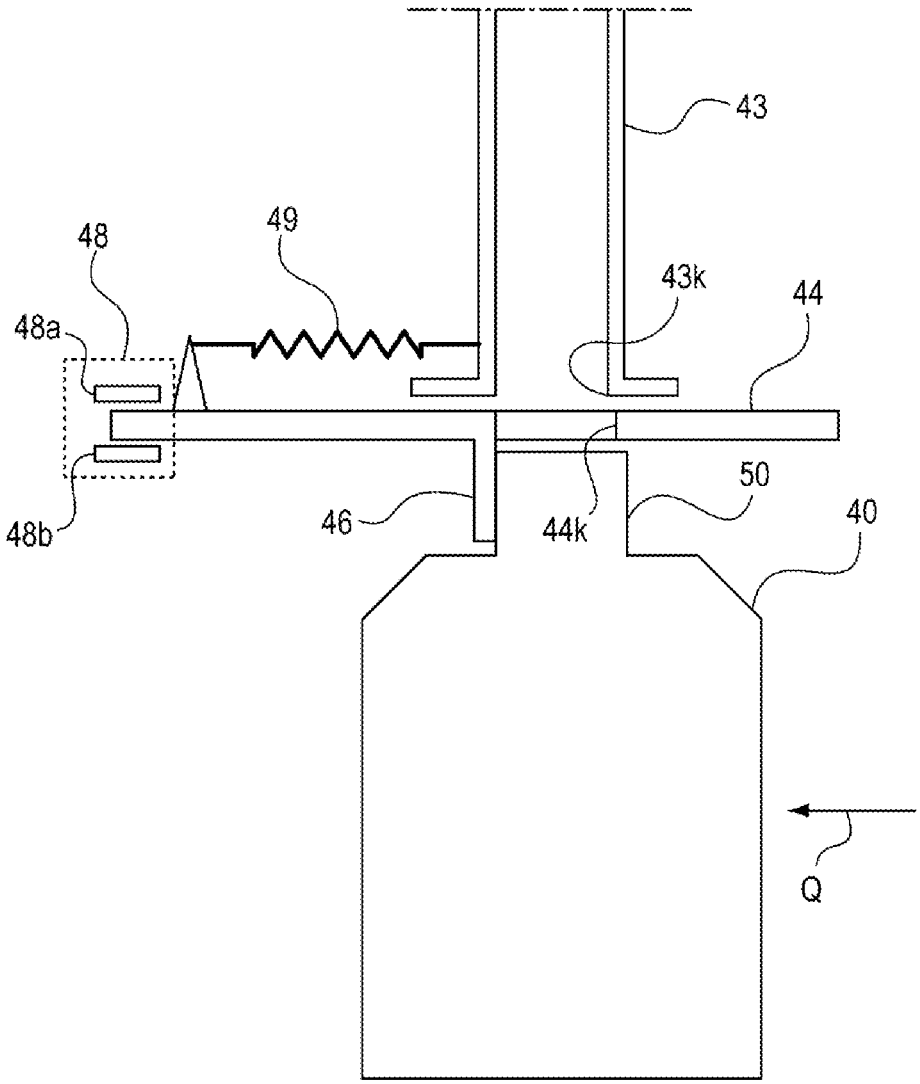
FIG. 4 is a side view illustrating a state in which the opening of the pipe is opened by the shutter seen from the direction of the arrow J in FIG. 2.

FIG. 4 is a side view illustrating a state in which the opening 43*k* of the pipe 43 is opened by the shutter 44 seen from the direction of the arrow J in FIG. 2. As illustrated in FIG. 4, the sensor 48 is arranged on a left side of the shutter 44. The sensor 48 includes a transmitting portion 48*a* and a receiving portion 48*b*. When the collecting container 40 is inserted from the outside to the inside of the apparatus main body 100A (direction of arrow Q), a neck portion 50 of the collecting container 40 makes contact with the container contacting portion 46, and the shutter 44 moves in the direction of the arrow Q. The opening 43*k* of the pipe 43 and the opening 44*k* of the shutter 44 communicate by the movement of the shutter 44. At the same time, the shutter 44 is inserted between the transmitting portion 48*a* and the receiving portion 48*b* of the sensor 48, and the sensor 48 detects the shutter 44. As a result, the openings 43*k* and 44*k* are in a communicated state when the collecting container 40 is inserted to the apparatus main body 100A.

When the collecting container 40 is detached from the inside of the apparatus main body 100A, on the other hand, the spring 49 pulls the supporting portion 80 toward the right side, as illustrated in FIG. 3. The collecting container 40 thus separates away from the container contacting portion 46 and the shutter 44 moves to the right side. A closed state in which the opening 43*k* of the pipe 43 is closed by the shutter 44 is obtained. The opening 43*k* of the pipe 43 is thereby closed, and the toner is suppressed from dropping.

The sensor 48 described above will be described using an optical photosensor by way of example, but a push switch and the like that is operated when mechanically pushed may be used.

As illustrated in FIG. 3, when the collecting container 40 is not inserted to the apparatus main body 100A, the shutter 44 has not reached the sensor 48, and the controller 70 determines that the collecting container 40 is "not present" inside the apparatus main body 100A in this state.

As illustrated in FIG. 4, when the collecting container 40 is inserted to the apparatus main body 100A, the shutter 44 has reached the sensor 48, and controller 70 determines that the collecting container 40 is "present" inside the apparatus main body 100A in this state.

Figure 5:
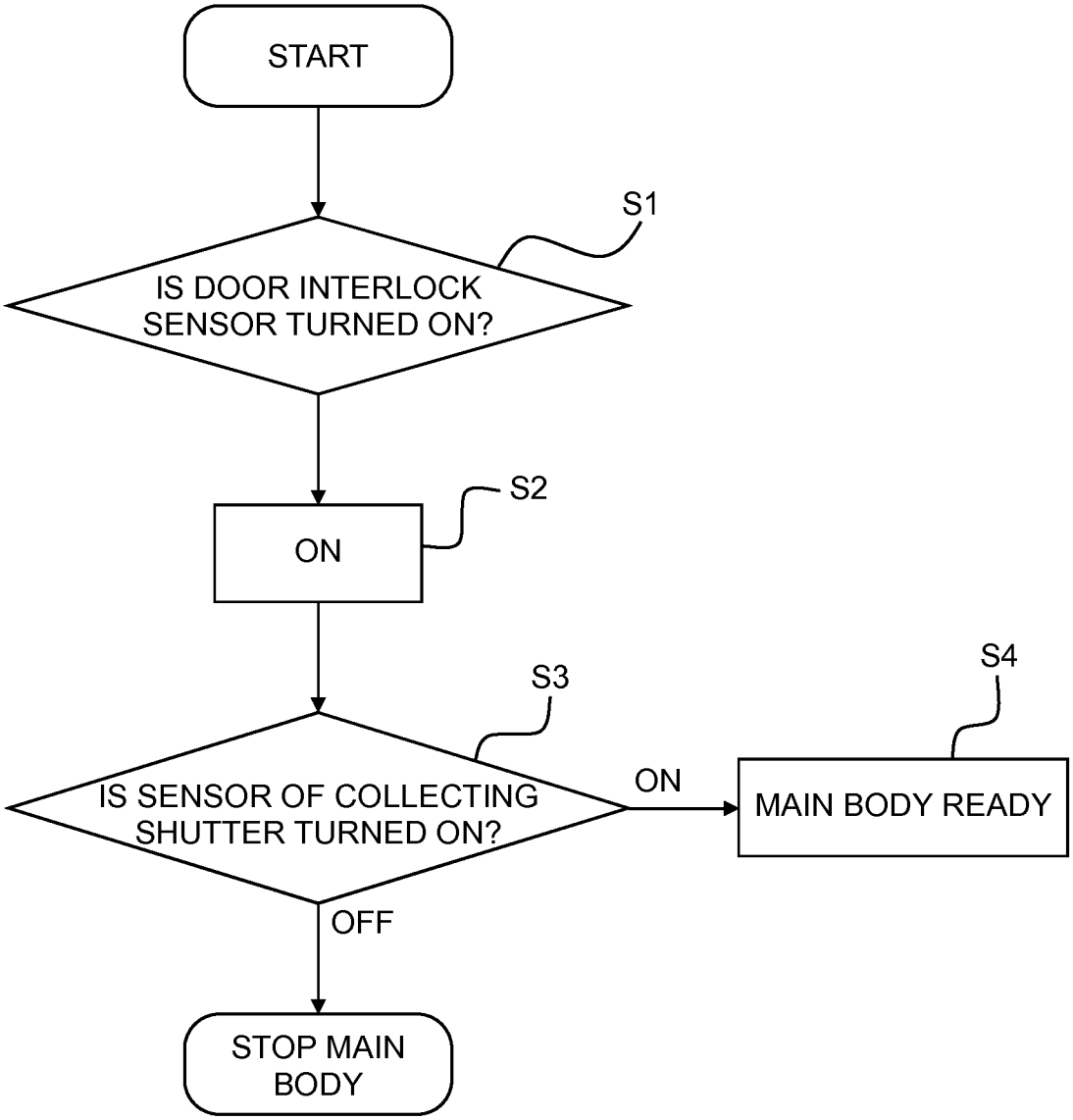
FIG. 5 is a flowchart illustrating a control process of a controller.

FIG. 5 is a flowchart illustrating a control process of the controller 70. As illustrated in FIG. 5, the control of the controller 70 is started with a door interlock sensor, which is installed in front of the collecting container 40 (not illustrated), as a starting point of the ON/OFF signal. The controller 70 determines whether or not the door interlock sensor is turned ON (S1). If the door interlock sensor is turned ON (S2), the controller 70 determines whether the sensor 48 is turned ON or OFF (S3).

If determined that the sensor 48 is turned OFF, the controller 70 stops the image forming operation of the apparatus main body 100A. The case in which determination is made that the sensor 48 is turned OFF is a case in which the collecting container 40 is not inserted to the apparatus main body 100A, and the opening 43*k* of the pipe 43 is closed by the shutter 44. Thus, the toner is not discharged to the outside of the apparatus main body 100A even if the collected toner is conveyed. In this state, the conveyed collected toner fills the inside of the pipe 43, and thus the image forming operation is stopped (main body stopped) when the collecting container 40 is not inserted, and it is determined that the collecting container 40 is "not present" in the apparatus main body 100A.

When the controller 70 determines that the sensor 48 is turned ON, the collecting container 40 is inserted, and determination is made that the collecting container 40 is "present" in the apparatus main body 100A, and the controller 70 performs the control to obtain the image forming operation enabled (READY) state.

In recent years, the component mounting density of the image forming apparatus 100 becomes higher with higher function. The conveying path of the collected toner is arranged in a limited space inside the apparatus main body 100A. Thus, a need to move the conveying path of the collecting toner arises at the time of maintenance of the apparatus main body 100A. For example, as illustrated in FIG. 2, a sheet discharge door 37 is sometimes arranged adjacent to the collecting container 40 and the pipe 43. In this case, the discharge roller 39 arranged on the inner side of the sheet discharge door 37 is a component that is replaced periodically. At the time of replacement, the sheet discharge door 37 needs to be detached by removing a sheet discharge door hinge 38.

The sheet discharge door hinge 38 is arranged to be hidden by the pipe 43, and thus cannot be detached in this state. Conventionally, in such a case, the task is performed by detaching the pipe 43 from the pipe 42. However, the dissembling of the pipe, which is the conveying path, involves dirt caused by the scattering of the toner, and thus the conveying path needs to be cleaned in advance, which increases the maintenance time with the dissembling time of the pipe itself. According to the configuration of the embodiment, such adverse effect is resolved.

Figure 6:
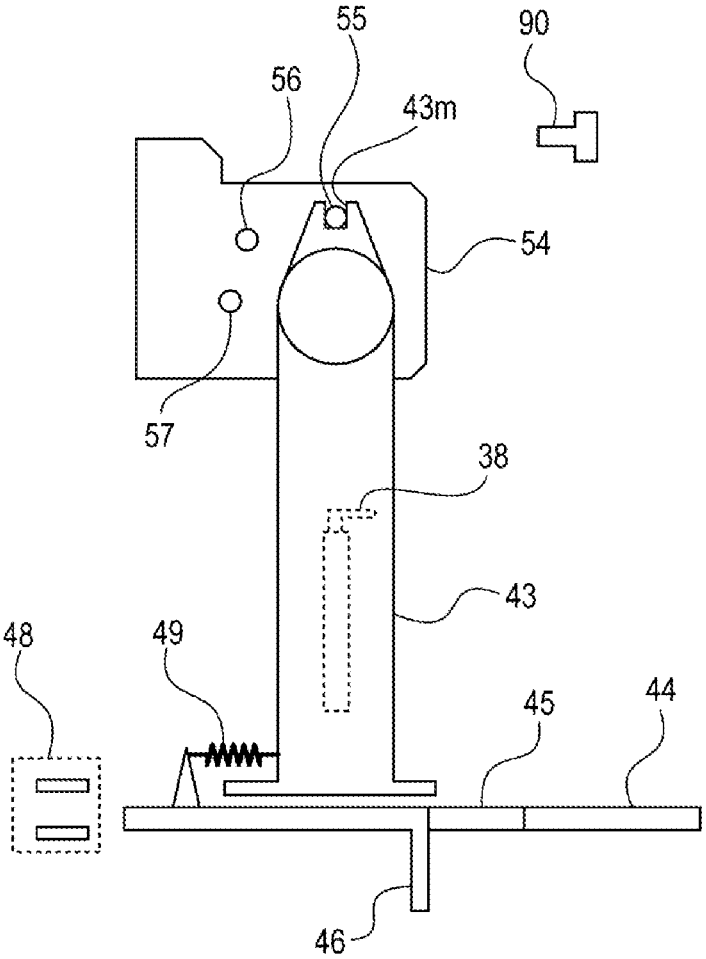
FIG. 6 is a side view illustrating a state in which a pipe is arranged in a vertical position.

FIG. 6 is a side view illustrating a state in which the pipe 43 is arranged in a vertical position (one of a first position). First to third fixing holes 55, 56, 57, which are "plurality of fixing portions", and a screw 90 fix the pipe 43 at a plurality of rotation angles. As illustrated in FIG. 6, a fixing member 54 is formed with the first fixing hole 55, the second fixing hole 56, and the third fixing hole 57. The screw 90 is attached to one of the first fixing hole 55, the second fixing hole 56, and the third fixing hole 57. The pipe 43 is formed with a recess 43*m*.

When the pipe 43 is arranged in the vertical position, the position of the recess 43*m* is aligned with the position of the first fixing hole 55 and the screw 90 is fixed to the first fixing hole 55. When the pipe 43 is arranged in the tilted position, the position of the recess 43*m* is aligned with the position of the second fixing hole 56 and the screw 90 is fixed to the second fixing hole 56. When the pipe 43 is arranged in the horizontal position, the position of the recess 43*m* is aligned with the position of the third fixing hole 57 and the screw 90 is fixed to the third fixing hole 57. When the screw 90 is detached, the pipe 43 can rotate about the pipe 42.

Figure 7:
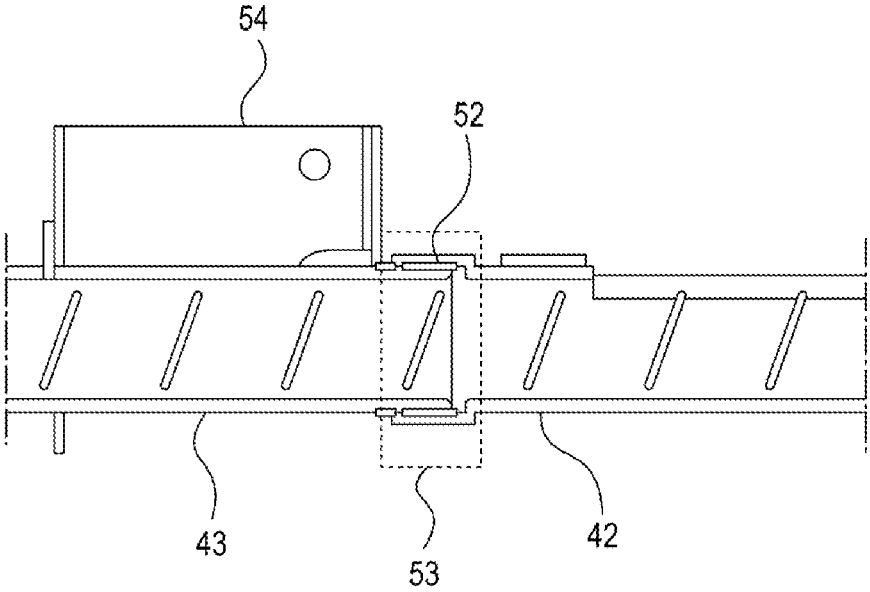
FIG. 7 illustrates a configuration of a coupling portion of the pipe and the pipe, and is an enlarged side view of the relevant portion of FIG. 2.

FIG. 7 illustrates a configuration of a coupling portion of the pipe 42 and the pipe 43, and is an enlarged side view of the relevant portion of FIG. 2. FIG. 7 illustrates the upper part of the pipe 43, where the pipe 43 extends in the vertical direction in FIG. 2 but the upper part is bent in the right direction, and such bent portion is illustrated in FIG. 7. An end of the pipe 43 is inserted to an end of the pipe 42, and the end of the pipe 43 rotates on the inner side of the end of the pipe 42. As illustrated in FIG. 7, the pipe 43 has a seal 52 adhered to the outer peripheral surface at a coupling portion 53 of the pipe 43 and the pipe 42. Even if the pipe 43 rotates with the pipe 42 as an axis, the coupling portion 53 is covered over the entire surface by the seal 52 in the peripheral direction, and thus the scattering of the toner is prevented.

Figure 8:
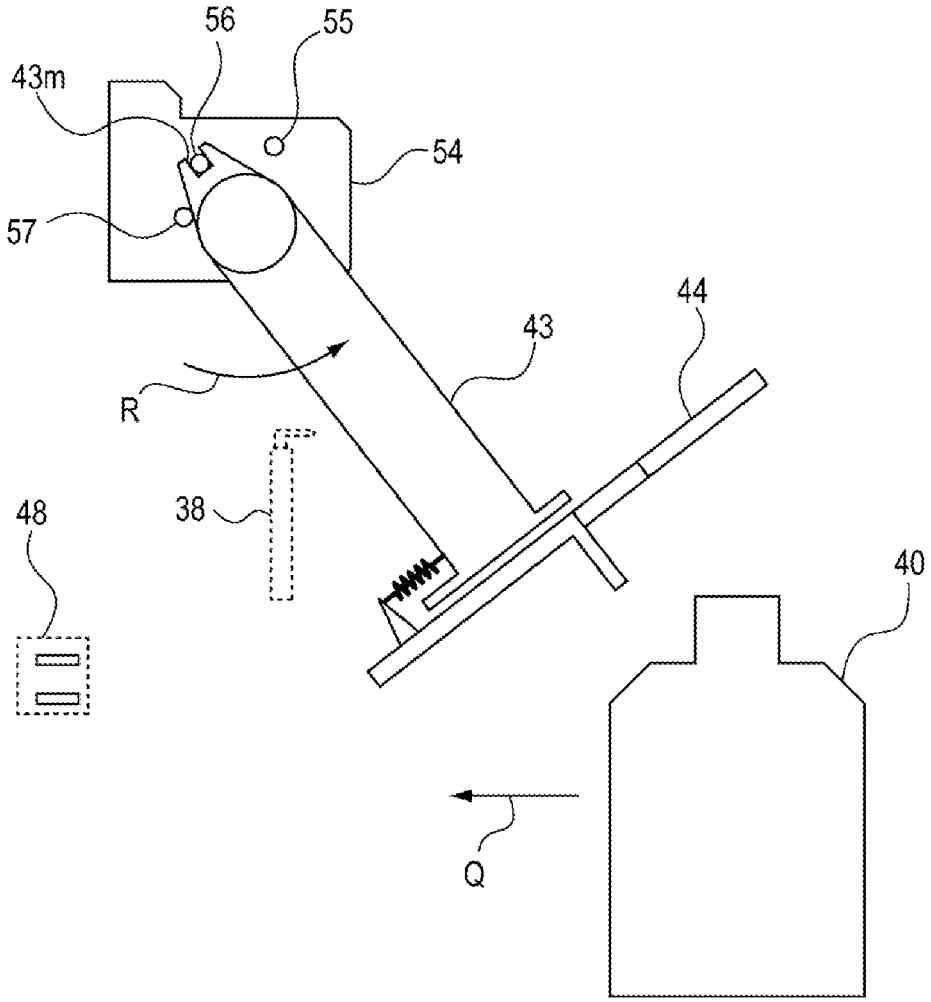
FIG. 8 is a side view illustrating a state in which the pipe is arranged in a tilted position.

FIG. 8 is a side view illustrating a state in which the pipe 43 is arranged in a tilted position of about 45 degrees (one of a second position). As illustrated in FIG. 8, the operator can access the sheet discharge door hinge 38 by rotating the pipe 43 in the direction of the arrow R. In this case, the recess 43*m* of the pipe 43 is moved to the position of the second fixing hole 56, and the screw 90 is fastened to the second fixing hole 56 of the fixing member 54 to fix the pipe 43. Thus, the operation can be performed without detaching the pipe 43 during maintenance.

In such a state that the pipe 43 is fixed with the second fixing hole 56 and the screw 90, the shutter 44 is tilted with respect to the direction of the arrow Q (bottle inserting direction). Thus, the shutter 44 does not smoothly operate when attempting to insert the collecting container 40 into the apparatus main body 100A, and does not reach the detection region of the sensor 48. Thus, the controller 70 determines that the collecting container is "not present" and does not perform the image forming operation. As a result, the breakage of the apparatus main body 100A that occurs when forgetting to return the fixing position of the pipe 43 at the time of maintenance can be prevented.

In the embodiment, the second fixing hole 56 and the third fixing hole 57, which is "at least one of the fixing portions" fix the position of the pipe 43 at the position where the sensor 48 does not operate with the collecting container 40 attached to the apparatus main body 100A. The number of fixing portions is not limited to such number.

Figure 9:
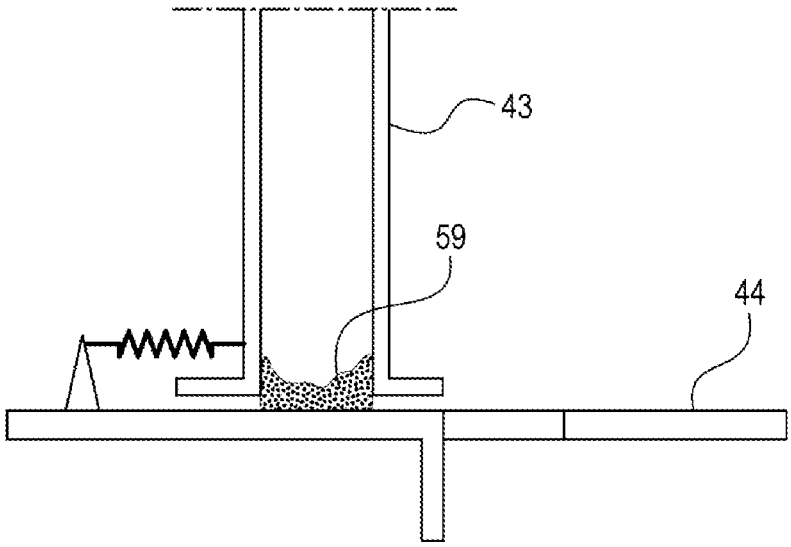
FIG. 9 is a cross-sectional view illustrating a state in which the residual toner is accumulated on the shutter.

FIG. 9 is a cross-sectional view illustrating a state in which the residual toner is accumulated on the shutter 44. The image forming apparatus 100 performs a check of the image forming operation after assembled in a factory. The collected toner 59 generated with the image forming operation is conveyed to the pipe 42 and the pipe 43. It is difficult to completely clean the collected toner 59 inside the pipe 42 and the pipe 43 if the collecting container 40 is attached to the apparatus main body 100A. The collected toner thus remains in the pipe 42 and the pipe 43 to some extent.

When transporting the image forming apparatus 100, the collecting container 40 is packaged separate from the apparatus main body 100A from the standpoint of transport efficiency. Thus, the residual collected toner reaches the pipe 42 and the pipe 43 by the vibration at the time of transportation, and eventually accumulates on the shutter 44, as illustrated in FIG. 9. Since the package is exposed to high temperature during the transportation, the toner accumulated on the shutter 44 strongly attaches thereto, thus causing the operation failure of the shutter 44.

Since the pipe 42 interiorly includes a conveying screw 41, the residual toner can be scraped off by the conveying screw 41 even if strongly attached. The pipe 43 does not interiorly include the conveying screw 41 and the toner conveying force merely depends on the weight of gravity applied on the collected toner 59, and thus if the toner accumulated on the shutter 44 strongly attaches to the inner wall surface of the pipe 43, the accumulated toner turns into a snow cornice form and becomes the cause of clogging of the collected toner.

Figure 10:
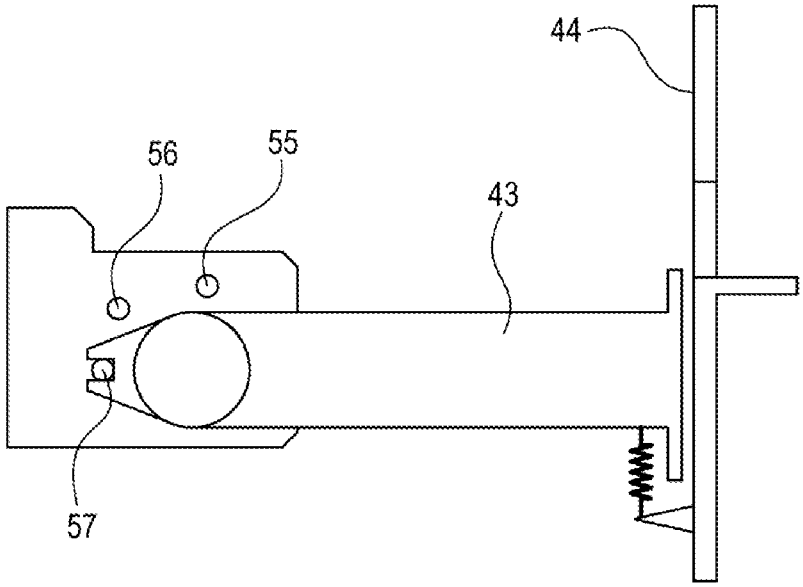
FIG. 10 is a side view illustrating a state in which the pipe is arranged in a horizontal position.

FIG. 10 is a side view illustrating a state in which the pipe 43 is arranged in a horizontal position. As illustrated in FIG. 10, the pipe 43 is maintained in the horizontal position while the image forming apparatus 100 is conveyed to the sale destination after being assembled in the factory. To prevent such clogging of the collected toner, the screw 90 is fastened to the third fixing hole 57 formed in the fixing member 54 during the transportation of the image forming apparatus 100 so that the pipe 43 is arranged and fixed in a substantially horizontal position. In the embodiment, the third fixing hole 57, which is "at least one of the fixing portions" desirably has the distal end of the pipe 43 set to the same height or higher than a basal end (center of rotation) of the pipe 43. The number of fixing portions is not limited to such number.

Thus, the pipe 43 can be rotated and the distal end can be set to the same height or higher with respect to the basal end. If the position of the pipe 43 is fixed, the collected toner is suppressed from moving from the pipe 42 to the pipe 43 and the attachment of the toner to the shutter 44 and the inner wall of the pipe 43 is suppressed during the transportation of the image forming apparatus 100.

When the pipe 43 is fixed with the third fixing hole 57 and the screw 90, a cooling fan is arranged in a space where the pipe 43 is to be arranged in the image forming operation enabled state after the installation. Thus, such position is a fixing position that can be used as a retracting position of the pipe 43 at the time of transportation, but the units are assembled after the apparatus main body 100A is installed in the installing area. Thus, it cannot be used as the retracting space of the pipe 43 at the time of maintenance after the installation.

According to the configuration of the embodiment described above, the conveying path for conveying the toner can be moved without dissembling the conveying path at the time of performing maintenance on the image forming apparatus 100, thus facilitating the maintenance.

The embodiment described above has been described mainly with a configuration in which the toner collected from the photosensitive drum 11, which serves as the "image bearing member", is cleaned with the cleaning device 15, which serves as the "cleaning portion", but is not limited to such configuration. A configuration in which the toner collected from the intermediate transfer belt 31 serving as the "image bearing member" is cleaned with the cleaning device 36 serving as the "cleaning portion" and the configuration being of the pipe 42 and the pipe 43 may be adopted.

In the embodiment described above, the configuration in which the pipe 42 takes the horizontal position and the pipe 43 takes the vertical position has been mainly described, but is not limited to such configuration. The pipe 42 may not exactly take the horizontal position and the pipe 42 may not exactly take the vertical position.

According to the present invention, the conveying path for conveying the toner can be moved without dissembling the conveying path at the time of performing maintenance on the image forming apparatus thus facilitating the maintenance.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-100138, filed Apr. 25, 2012, which is hereby incorporated by reference herein in its entirety.

What is claimed is:

1. An image forming apparatus comprising:

an image forming portion which forms a toner image;

a collecting container which is detachably arranged in an apparatus main body and which collects toner discharged from the image forming portion;

a conveying pipe which is movable in relation to the apparatus main body, and which conveys toner exhausted from the image forming portion to the collecting container, wherein the conveying pipe is rotatable to a first position and to a second position different from the first position;

a member which is configured to permit detaching of a portion of the apparatus main body that faces the collecting container, wherein the member is positioned so to overlap, in a direction along an axis of rotation of the conveying pipe, the conveying pipe when the conveying pipe is located at the first position, and to not overlap the conveying pipe when the conveying pipe is located at the second position; and a fixing portion which is configured to fix the conveying pipe in the first position and the second position.

2. The image forming apparatus according to claim 1, wherein the second position is a position of fixing the conveying pipe when performing maintenance on the apparatus main body.

3. The image forming apparatus according to claim 1, wherein a position of a downstream end in a conveying direction of the conveying pipe is higher at the second position than at the first position.

4. The image forming apparatus according to claim 1, wherein the first position is a position where a downstream end in a conveying direction of the conveying pipe is low with respect to an upstream end in the conveying direction, and wherein the second position includes a position where at least one end is the same height or higher than the other end.

5. The image forming apparatus according to claim 1, wherein the conveying pipe is moveable to a third position further away from the first position than the second position, wherein the third position is a position capable of attaching a device operated by the apparatus main body when the main apparatus body is shipped, and wherein the fixing portion is adapted to fix the conveying pipe at the third position.

6. The image forming apparatus according to claim 1, wherein the collecting container is capable of collecting the toner from the image forming portion when the collecting container is located at an attachment position, and wherein the apparatus further comprises:

a sensor capable of detecting whether or not the collecting container is attached at said attachment position when the conveying pipe is at the first position; and a controller which controls whether or not to perform an image forming operation based on a detection result of the sensor.

7. The image forming apparatus according to claim 1, wherein the conveying pipe extends in a toner discharge direction at the first position.

8. The image forming apparatus according to claim 1, wherein the conveying pipe includes a first conveying pipe fixed to the apparatus main body and a second conveying pipe which is arranged to be orthogonal to the first conveying pipe and which turnably connects to the first conveying pipe, and a conveying member which is arranged in the first conveying pipe to convey the toner when driven.

* * * * *